US008049093B2

(12) United States Patent
Jeon et al.

(10) Patent No.: US 8,049,093 B2
(45) Date of Patent: Nov. 1, 2011

(54) METHOD AND APPARATUS FOR BEST MATCHING AN AUDIBLE QUERY TO A SET OF AUDIBLE TARGETS

(75) Inventors: Woojay Jeon, Chicago, IL (US); Changxue Ma, Barrington, IL (US)

(73) Assignee: Motorola Solutions, Inc., Schaumburg, IL (US)

( * ) Notice: Subject to any disclaimer, the term of this patent is extended or adjusted under 35 U.S.C. 154(b) by 0 days.

(21) Appl. No.: 12/649,458

(22) Filed: Dec. 30, 2009

(65) Prior Publication Data

US 2011/0154977 A1 Jun. 30, 2011

(51) Int. Cl.
*G04B 13/00* (2006.01)

(52) U.S. Cl. ..... 84/609; 84/615; 84/616; 84/649; 84/653; 84/654

(58) Field of Classification Search ..... None
See application file for complete search history.

(56) References Cited

U.S. PATENT DOCUMENTS

| | | | | |
|---|---|---|---|---|
| 5,874,686 | A * | 2/1999 | Ghias et al. | 84/609 |
| 6,121,530 | A * | 9/2000 | Sonoda | 84/609 |
| 7,031,980 | B2 | 4/2006 | Logan et al. | |
| 7,667,125 | B2 * | 2/2010 | Taub et al. | 84/616 |
| 7,714,222 | B2 * | 5/2010 | Taub et al. | 84/600 |
| 7,838,755 | B2 * | 11/2010 | Taub et al. | 84/609 |
| 7,884,276 | B2 * | 2/2011 | Taub et al. | 84/612 |
| 2003/0023421 | A1 * | 1/2003 | Finn et al. | 704/1 |
| 2007/0163425 | A1 * | 7/2007 | Tsui et al. | 84/609 |
| 2008/0148924 | A1 * | 6/2008 | Tsui et al. | 84/618 |

OTHER PUBLICATIONS

Jeon, et al., "An Efficient Signal-Matching Approach to Melody Indexing and Search Using Continuous Pitch Contours and Wavelets," 10th International Society for Music Information Retrieval Conference (ISMIR 2009), Kobe, Japan, Oct. 26-30, 2009, pp. 681-686.

Wang, et al., "Improving Searching Speed and Accuracy of Query by Humming System Based on Three Methods: Feature Fusion, Candidates Set Reduction and Multiple Similarity Measurement Rescoring", In INTERSPEECH-2008, 2024-2027.

Jang, et al, "Hierarchical Filtering Method for Content-Based Music Retrieval via Acoustic Input," Proceedings of the 9th ACM International Conference on Multimedia, Ottawa, Canada, 2001, vol. 9, pp. 401-410.

Unal, et al, "Challenging Uncertainty in Query by Humming Systems: A Fingerprint Approach," IEEE Transactions on Audio, Speech and Language Processing, vol. 16, Issue 2, Feb. 2008, pp. 359-371.

Mazzoni, et al., "Melody Matching Directly from Audio," 2nd Annual International Symposium on Music Information Retrieval, Bloomington: Indiana University, 2001, pp. 73-82. Guo, et al., "Content-Based Retrieval of Polyphonic Music Objects Using Pitch Contour," 2008 IEEE International Conference on Acoustics, Speech and Signal Processing, Las Vegas, Nevada, USA, Mar. 30-Apr. 4, 2008, pp. 2205-2208.

Keogh, et al., "Scaling Up Dynamic Time Warping for Datamining Applications," Proceedings of the 6th ACM SIGKDD International Conference on Knowledge Discovery and Data Mining (KDD-2000), Boston MA, USA, Aug. 20-23, 2000, pp. 285-289.

Rabiner, et al., "Fundamentals of Speech Recognition," Prentice Hall, 1993, pp. 200-209; 220-226; 400-309.

* cited by examiner

*Primary Examiner* — Marlo Fletcher

(57) ABSTRACT

During operation, a "coarse search" stage applies variable-scale windowing on the query pitch contours to compare them with fixed-length segments of target pitch contours to find matching candidates while efficiently scanning over variable tempo differences and target locations. Because the target segments are of fixed-length, this has the effect of drastically reducing the storage space required in a prior-art method. Furthermore, by breaking the query contours into parts, rhythmic inconsistencies can be more flexibly handled. Normalization is also applied to the contours to allow comparisons independent of differences in musical key. In a "fine search" stage, a "segmental" dynamic time warping (DTW) method is applied that calculates a more accurate similarity score between the query and each candidate target with more explicit consideration toward rhythmic inconsistencies.

19 Claims, 6 Drawing Sheets

500

METHOD AND APPARATUS FOR BEST MATCHING AN AUDIBLE QUERY TO A SET OF AUDIBLE TARGETS

FIELD OF THE INVENTION

The present invention relates generally to a method and for best matching an audible query to a set of audible targets and in particular, to the efficient matching of pitch contours for music melody searching using wavelet transforms and segmental dynamic time warping.

BACKGROUND OF THE INVENTION

Music melody matching, usually presented in the form of Query-by-Humming (QBH), is a content-based way of retrieving music data. Previous techniques searched melodies based on either their "continuous (frame-based)" pitch contours or their note transcriptions. The former are pitch values sampled at fixed, short intervals (usually 10 ms), while the latter are sequences of quantized, symbolic representations of melodies. For example, the former may be a sampled curve starting at 262 Hz, rising to 294 Hz and then to 329 Hz, before dropping down to and staying at 196 Hz, while the latter (corresponding to the former) may be "C4-D4-E4-G3-G3" or "Up-Up-Down-Same." Frame-based pitch contours (which we call hereon "pitch contours") have been suggested in the past as providing more accurate match results compared to the predominantly-used note transcriptions because the latter may segment and quantize dynamic pitch values too rigidly, compounding the effect of pitch estimation errors. The major drawback is that pitch contours hold much more data and therefore require much more computation than note-based representations, especially when using the popular dynamic time warping (DTW) to measure the similarity between two melodies.

No method has been reported so far that can efficiently match frame-based pitch contours while adjusting for music key shifts, tempo differences, and rhythmic inconsistencies between query and target and also search arbitrary locations of targets. Previous methods using pitch contours are limited in that they require the query and target to have reasonably similar tempo, or constrain the starting locations of query melodies to the beginning of specific music phrases. Some methods do not have these limitations, but on the other hand, require far too much computation for practical use because they do dynamic programming over huge spaces of data. Therefore, a need exists for a method and apparatus that can accurately and efficiently match an audible query to a set of audible targets and can accommodate for music key shifts, tempo differences, and rhythmic inconsistencies between query and target, while also searching arbitrary locations of targets.

Figure 1:
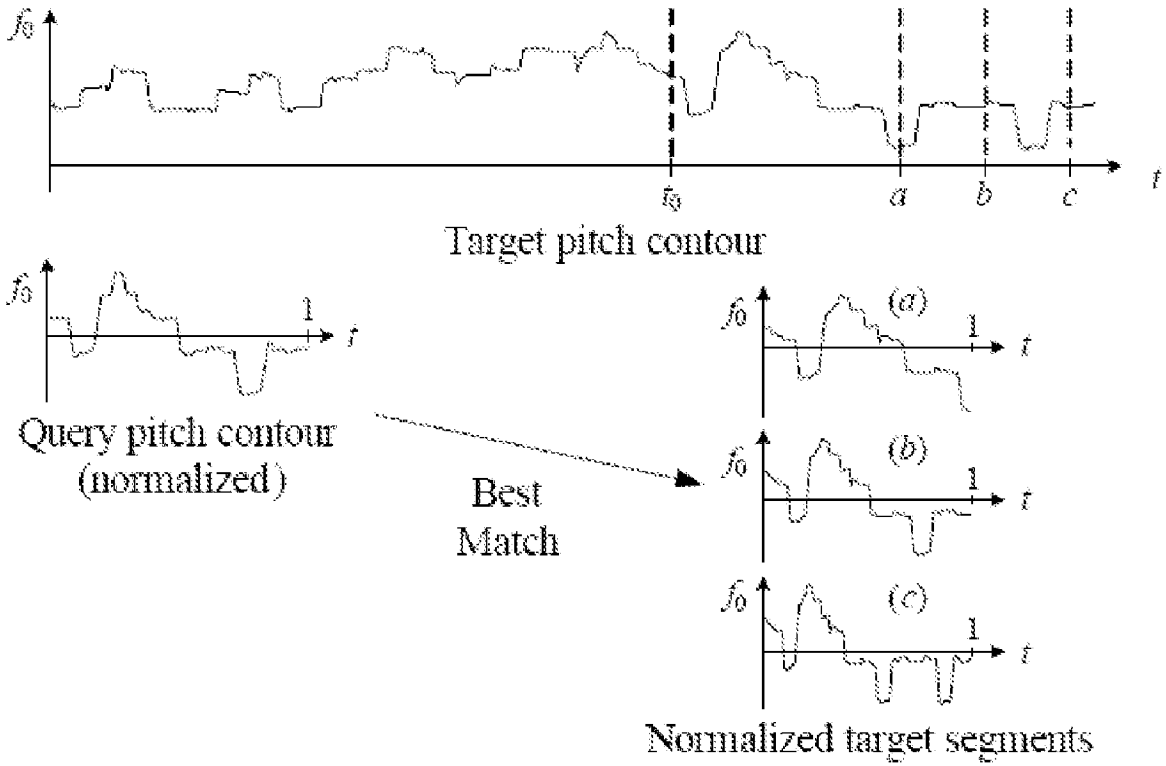
FIG. 1 illustrates a prior-art technique for matching a query pitch contour to a target.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. Those skilled in the art will further recognize that references to specific implementation embodiments such as "circuitry" may equally be accomplished via replacement with software instruction executions either on general purpose computing apparatus (e.g., CPU) or specialized processing apparatus (e.g., DSP). It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION OF THE DRAWINGS

In order to alleviate the above-mentioned need, a method and apparatus for best matching an audible query to a set of audible targets is provided herein. During operation, a "coarse search" stage applies variable-scale windowing on the query contours to compare them with fixed-length segments of target contours to find matching candidates while efficiently scanning over variable tempo differences and target locations. Because the target segments are of fixed-length, this has the effect of drastically reducing the storage space required in a prior-art method, *An efficient signal-matching approach to melody indexing and search using continuous pitch contours and wavelets* by W. Jeon, C. Ma, and Y.-M. Cheng, Proceedings of the International Society for Music Information Retrieval, 2009. Furthermore, by breaking the query contours into parts, rhythmic inconsistencies can be more flexibly handled. In a "fine search" stage, a "segmental" dynamic time warping (DTW) method is applied that calculates a more accurate similarity score between the query and each candidate target with more explicit consideration toward rhythmic inconsistencies.

Even though segmental DTW is an approximation of the conventional DTW that sacrifices some accuracy, the above allows faster computation that is suitable for practical application.

Multi-Scale Windowing for Fast Search

It is well-known that a real, continuous-time signal x(t) may be decomposed into a linear combination of a set of wavelets that form an orthonormal basis of a Hilbert Space, as described in *Ten Lectures on Wavelets* by I. Daubechies, Society for Industrial and Applied Mathematics, 1992. A real-valued wavelet can be defined as $$\psi_{m,n}(t)=2^{-m/2}\psi(2^{-m}t-n) \tag{1}$$

where m, n are real numbers and m is a dilation factor and n is a displacement factor. $\psi(t)$ is a mother wavelet function (e.g., the Haar Wavelet). The wavelet coefficient of a signal x(t) that corresponds to the wavelet $\psi_{m,n}(t)$ is defined as the inner product between the two signals:

$$\langle x(t),\psi_{m,n}(t)\rangle=\int_{-\infty}^{+\infty}x(t)\psi_{m,n}(t)dt \quad (2)$$

It is also well known that signals are well-represented by a relatively compact set of coefficients, so the distance between two real signals can be efficiently computed using the following relation:

$$\int_{-\infty}^{+\infty}\{x(t)-y(t)\}^2\,dt=\sum_{j,k\in z}(\langle x,\psi_{j,k}\rangle-\langle y,\psi_{j,k}\rangle)^2 \quad (3)$$

In essence, a prior-art matching technique described in *An efficient signal-matching approach to melody indexing and search using continuous pitch contours and wavelets* by W. Jeon, C. Ma, and Y.-M. Cheng, Proceedings of the International Society for Music Information Retrieval, 2009, divides a target contour p(t) into overlapping segments. For a given position $t_0$ in a target contour, the query (e.g., a hummed or sung portion of a song) is compared with multiple segments of the target contour starting at $t_0$ to handle a range of tempo differences between query and target. FIG. 1 shows an example. All segments are normalized in length (i.e., "time-normalized") so that they could be directly compared using a simple mean squared distance measure. That is, for a segment p(t) at $t_0$ with length T, we obtain the time-normalized segment:

$$p'(t)\triangleq p(Tt+t_0) \quad (4)$$

In the above relation, p'(t) is assumed to be 0 outside of the range [0,1). Since the pitch values are log frequencies, the mean of the time-normalized segment is then subtracted to normalize the musical key (i.e., "key-normalize") of each segment, resulting in the time-normalized and key-normalized segment:

$$p'_N(t)=p(Tt+t_0)-\int_0^1 p(Tt+t_0)dt \quad (5)$$

on $t\in[0, 1)$ and 0 elsewhere. This segment can be efficiently represented by a set of wavelet coefficients:

$$\langle p'_N,\psi_{j,k}\rangle=\begin{cases}T^{-1/2}\langle p(t+t_0),\psi_{m,n}\rangle & j,k\in\mathcal{W},\ m=j+\log_2 T,\ n=k\\ 0 & \text{all other } j,k\in\mathcal{Z}\end{cases} \quad (6)$$

where $W=\{(j,k): j\leqq 0, 0\leqq k\leqq 2^{-j}-1, j\in Z, k\in 'Z'\}$

All of these segments have to be stored in a database, which could be quite space-consuming.

Figure 2:
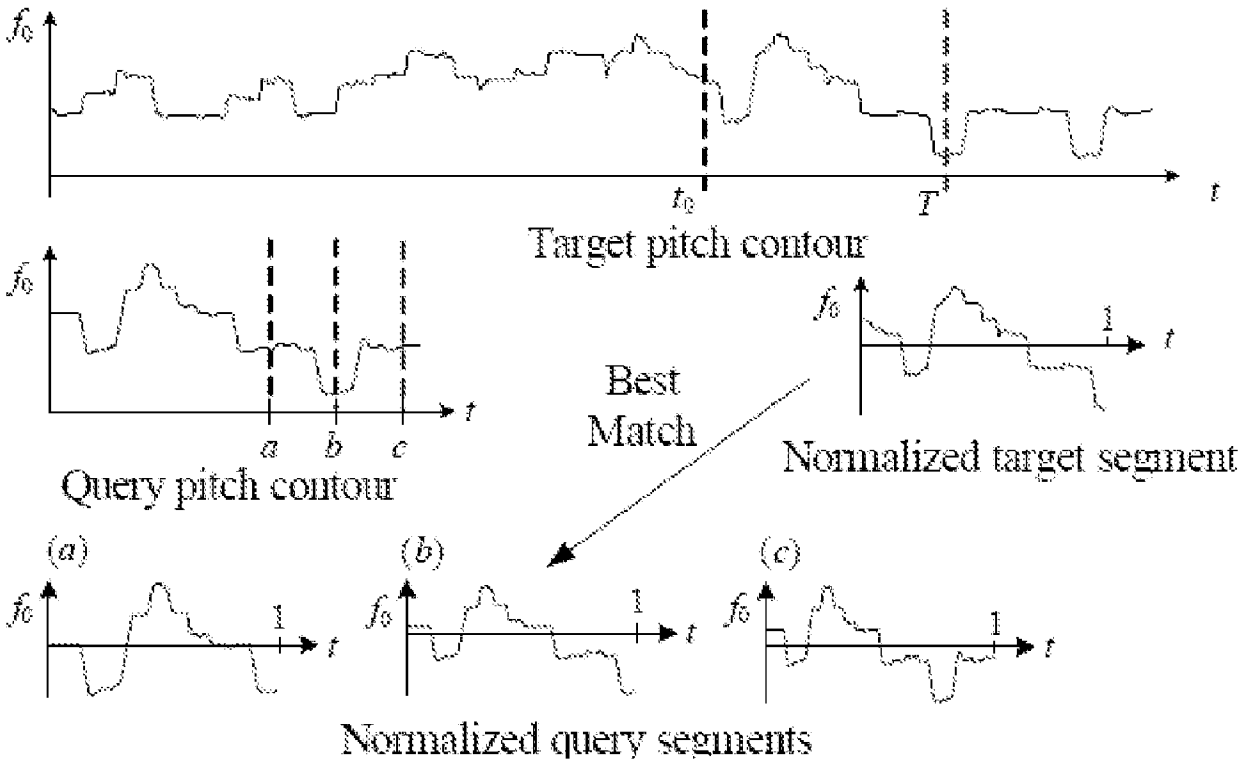
FIG. 2 illustrates an example of variable-length windowing on a query contour to compare multiple segments of the query with the target segment.

In the proposed method, we instead use fixed-length windows for all target contours so that for each position $t_0$ in a given target song (where the term "song" denotes any sort of music piece, including vocal and instrumental music pieces), there is only one target segment of fixed length. We then apply variable-length windowing on the query contour to compare multiple segments of the query with the target segment, as shown in FIG. 2. While FIG. 2 shows an example of three segments being obtained from the query pitch contour, more segments may be obtained depending on system parameters, and each segment need not start at the beginning of the query contour.

Each segment of the query contour is time-normalized and key-normalized, as is every target contour segment in the database, so that they may be directly compared using a vector mean square distance as in equation (3), independent of differences in musical key. Compared to the previous method mentioned above, the database holding the target segments becomes much smaller. Another effect is that the query can be broken into more than one segment if T is short enough compared to the length of the query. With the addition of some heuristics when performing the matches of successive segments of the query with successive target segments, rhythmic inconsistencies between query and target can be handled more robustly compared to the prior art, where the entire query contour was rigidly compared with the target segments. Search speed is fast because the target segments can be represented by their wavelet coefficients in equation (6), which can be stored in a data structure such as a binary tree or hash for efficient search.

This method is used as a "coarse" search stage where an initial, long list of candidate target songs that tentatively match the query is created along with their approximate matching positions ($t_0$ in FIG. 2). DTW can then be applied in the next "fine" search stage to compute more accurate distances to re-rank the targets in the list.

Segmental Dynamic Timewarping

Dynamic time warping (DTW) is very commonly used for matching melody sequences, and has been proposed in many different flavors. In this section, we will begin by formulating an "optimal" DTW criterion under the assumption of frame-based pitch contours. Although modified "fast" forms of general DTW have been studied in the past, there exist some issues specific to melody pitch contours that require a formal mathematical treatment. We will address these issues here and derive a "segmental" DTW method as an approximation of the optimal method.

Problem Formulation

Assume a query pitch contour q(t) and target pitch contour p(t), each defined on a bounded interval on the continuous t-axis (note that "continuous" here does not mean "frame-based" as was used above). Assume we sample the contours at equal rates and obtain the sets of samples $Q=\{q_1, q_2, \ldots, q_{|Q|}\}$ and $P=\{p_1, p_2, \ldots, p_{|P|}\}$, where |Q| and |P| represent the cardinality of Q and P, respectively. The distance between Q and P according to the warping functions $\phi_q(\bullet)$ and $\psi_p(\bullet)$ where the total number of warping operations is T is $$D(Q,P;\phi_q,\phi_q,b)=\sum_{i=1}^{T}d(\phi_q(i),\phi_p(i);b(i)) \quad (7)$$

Note that an extra parameter b(i) has been added. This is a bias factor indicating the difference in key between the query and target. If the target is sung at one octave higher than the query, for example, we can add 1 to all members in Q for the pitch values to be directly comparable, assuming all values are $\log_2$ frequencies. We define the distance function as simply the squared difference between the target pitch and the biased query pitch:

$$d(\psi_q(i),\psi_p(i);b(i))=[q\{\psi_q(i)\}+b(i)-p\{\psi_p(i)\}]^2 \quad (8)$$

It is reasonable to assume that the bias b(i) remains roughly constant with respect to i. That is, every singer should not deviate too much off-key, although he is free to choose whatever key he wishes. We can constrain b(i) to be tied to an overall bias b as follows, and determine it based on whatever warping functions and bias values are being considered:

$$\begin{cases} b(i) = b + \delta_i \\ \delta_i = \arg\min_{\delta, |\delta| \le \Delta} [q\{\phi_q(i)\} + b + \delta - p\{\phi_p(i)\}]^2 \end{cases} \tag{9}$$

In the equation above, Δ is the maximum allowable deviation of b(i) from b.

Hence, the goal is to find the warping functions and the bias value that will minimize the overall distance between P and Q:

$$D^* = \min_{\phi_q, \phi_q, b} D(Q, P; \phi_q, \phi_q, b) \tag{10}$$

DTW can be used to solve this equation. However, this would be extremely computationally intensive. If the set $B=\{b_1, b_2, \ldots, b_{|B|}\}$ denoted the set of all possible values of b, we would essentially have to consider all possible paths within a three-dimensional $|Q|\times|P|\times|B|$ space.

Approximate Segmental Dynamic Time Warping

Figure 3:
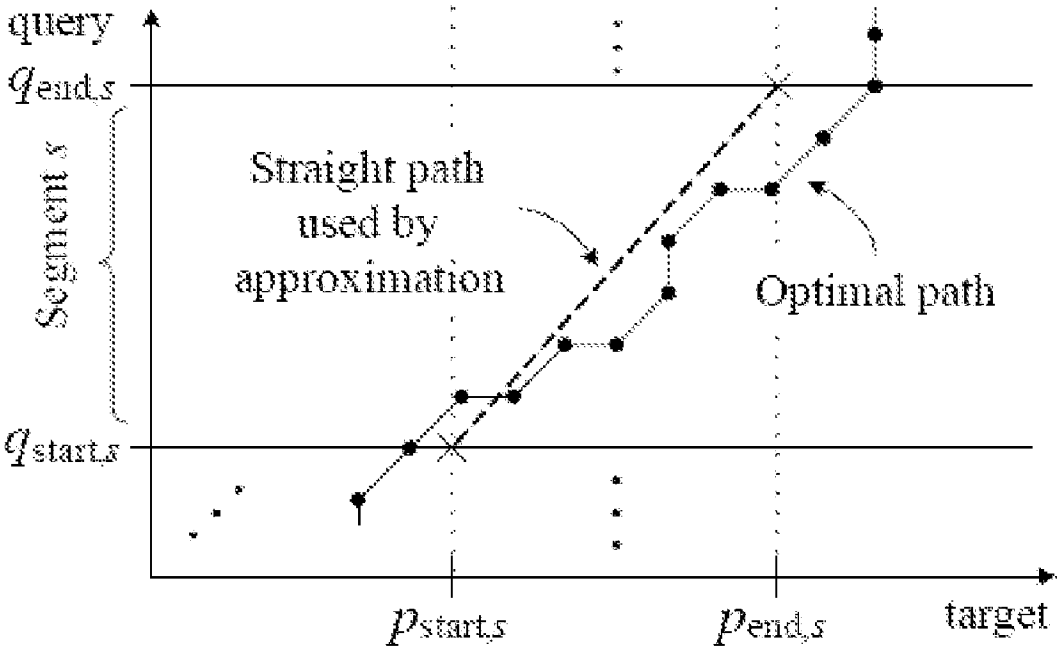
FIG. 3 illustrates a conceptual diagram of approximate segmental DTW.

We now propose a "segmental" DTW method that approximates equation (5). This is illustrated in FIG. 3. First, we partition the warping sequence into $N \leqq T$ parts, defined by a monotonically increasing sequence of integers $\theta_1, \ldots, \theta_{Ns+1}$ where $\theta_1=0$ and $\theta_{Ns+1}=T$. We rewrite equation (2) as $$D = \sum_{s=1}^{N} \sum_{i=\theta_{s+1}}^{\theta_{s+1}} d(\phi_q(i), \phi_p(i); b + \delta_i) \tag{11}$$

The first approximation is to assume that the $\delta_i$'s are constant within each partition, i.e., $$\delta_i = \delta_s (\theta_s + 1 \leqq i \leqq \theta_{s+1}) \tag{12}$$

Next, we approximate the partial summations above as integrals, assuming that $\phi_p(i)$ and $\phi_q(i)$ are defined on the continuous-time t-axis as well as the discrete-time i-axis. Using this integral form proves to be convenient later:

$$D \approx \sum_{s=1}^{N} \int_{\theta_s}^{\theta_{s+1}} d(\phi_q(t), \phi_p(t); b + \delta_s)\, dt \tag{13}$$

The third approximation is to assume that the warping functions $\phi_p(i)$ and $\phi_q(i)$ are straight lines within each partition, bounded by the following endpoints:

$$\begin{cases} \phi_q(\theta_s) = q_{start,s},\ \phi_q(\theta_{s+1}) = q_{end,s} \\ \phi_p(\theta_s) = p_{start,s},\ \phi_p(\theta_{s+1}) = p_{end,s} \end{cases} \tag{14}$$

This results in the following warping functions:

$$\begin{cases} \phi_q(t) = \dfrac{q_{end,s} - q_{start,s}}{\theta_{s+1} - \theta_s}(t - \theta_s) + q_{start,s} \\ \phi_p(t) = \dfrac{p_{end,s} - p_{start,s}}{\theta_{s+1} - \theta_s}(t - \theta_s) + p_{start,s} \end{cases} \tag{15}$$

Conceptually, this step is similar to modified DTW methods that use piecewise approximations of data in that the amount of data involved in the dynamic programming is being reduced to result in a smaller search space. Substituting this into equation (13) and applying equation (8), we get $$D = \sum_{s=1}^{N} (\theta_{s+1} - \theta_s) \int_0^1 (q'_s(t) + b + \delta_s - p'_s(t))^2\, dt \tag{16}$$

where $q'_s(t)$ and $p'_s(t)$ are essentially the "time-normalized" versions of q(t) and p(t) in partition s:

$$\begin{cases} q'_s(\theta_s) = q\{(q_{end,s} - q_{start,s})t + q_{start,s}\} \\ p'_s(\theta_s) = p\{(p_{end,s} - p_{start,s})t + p_{start,s}\} \end{cases} \tag{17}$$

In equation (16), we set the weight factor to be the length of the query occupied by the partition.

$$w_s \triangleq \theta_{s+1} - \theta_s = \frac{q_{end,s} - q_{start,s}}{q_{|Q|} - q_{start,1}} \tag{18}$$

In equation (9), we set $\delta_i$ such that it minimizes the cost at time i. Here, we set $\delta_s$ such that it minimizes the overall cost in segment s:

$$\delta_s = \arg\min_{\delta, |\delta| \le \Delta} \int_0^1 (q'_s(t) + b + \delta - p'_s(t))^2\, dt \tag{19}$$

Since the integral in the above equation is quadratic with respect to δ, the solution can be easily found to be $$\delta_s \begin{cases} \xi_s & \text{if } -\delta \le \xi_s \le \delta \\ -\delta & \text{if } \xi_s < -\delta \\ \delta & \text{if } \xi_s > \delta \end{cases} \tag{20}$$

where $$\begin{aligned} \xi_s &= \int_0^1 (p'_s(t) - q'_s(t) - b)\, dt \\ &\approx -b + \frac{1}{p_{end,s} - p_{start,s}} \sum_{p_{start,s}+1}^{p_{end,s}} p_i - \\ &\quad \frac{1}{q_{end,s} - q_{start,s}} \sum_{q_{start,s}+1}^{q_{end,s}} q_i \end{aligned} \tag{21}$$

There still remains the problem of finding b. We set it to the value that minimizes the cost for the first segment, with $\delta_1$ set to 0:

$$b = \underset{b'}{\operatorname{argmin}} \int_0^1 (q_1'(t) + b' - p_1'(t))^2 dt = \int_0^1 (p_1'(t) - q_1'(t)) dt \approx \frac{1}{p_{end,s} - p_{start,s}} \sum_{p_{start,s}+1}^{p_{end,s}} p_i - \frac{1}{q_{end,s} - q_{start,s}} \sum_{q_{start,s}+1}^{q_{end,s}} q_i \tag{22}$$

In equation (14), we assume that the query boundary points $q_{start,s}$ and $q_{end,s}$ are provided to us by some query segmentation rule. The optimization criterion can now be summarized as $$D^* = \min_{\phi_v} \sum_{s=1}^{N} w_s \int_0^1 (q_s'(t) + b + \delta_s - p_s'(t))^2 dt \tag{23}$$

where $\phi_p$ is completely defined by the set of target contour boundary points, $\{p_{start,1}, \ldots, p_{start,N}\}$ and $\{p_{end,1}, \ldots, p_{end,N}\}$. In the equation above,

- N is the number of segments that the query is broken into (note that these segments are not necessarily the same as the segments used in the coarse search stage)
- $w_s$ is the weight of each segment, as defined in (18)
- $q'_s(t)$ is the time-normalized version of q(t) in partition s, as defined in (17)
- $p'_s(t)$ is the time-normalized version of p(t) in partition s, as defined in (17)
- b is the bias value in (22)
- $\delta_s$ is the deviation factor in (20)

All other variables in equation (23) depend on either $\phi_p$ or preset constants. Compared to the original "optimal" criterion in equation (10), the problem has been reduced to optimizing only 2N variables that define the target contour boundary points.

Segmental DTW Via Level-Building

Figure 4:
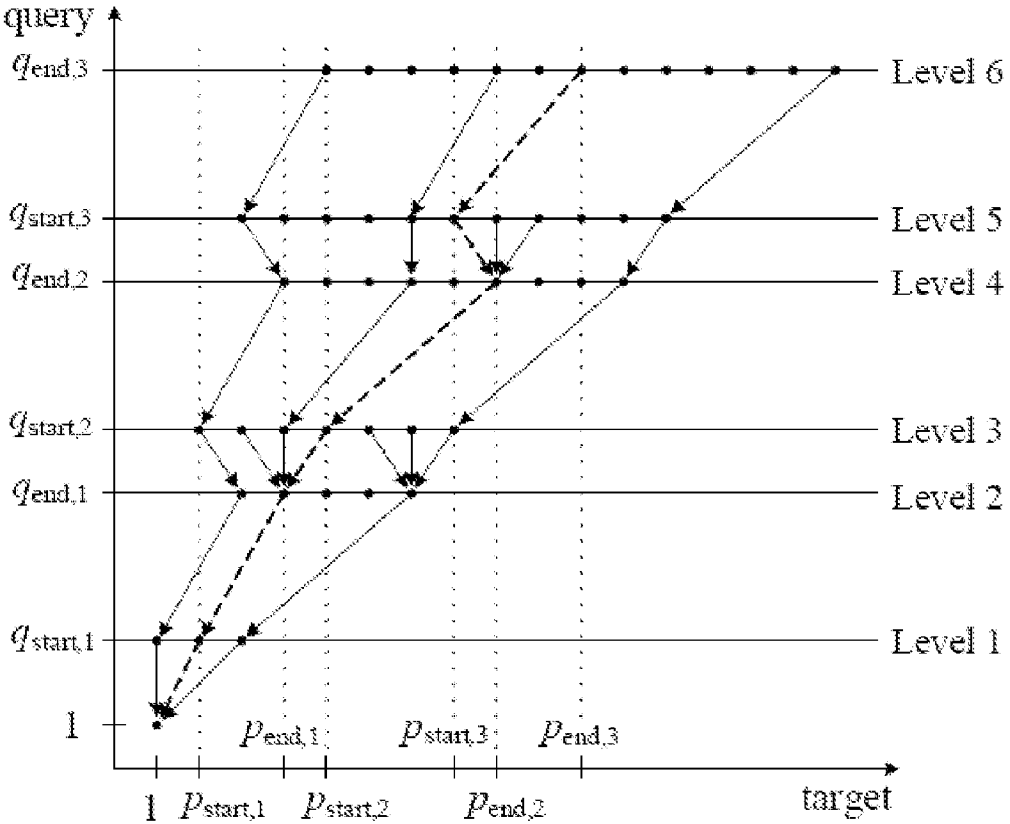
FIG. 4 shows an example level building scheme.

Equation (23) can be solved using a level-building approach, similar to the connected word recognition example in L. Rabiner and B.-H. Juang, *Fundamentals of Speech Recognition*, Prentice Hall, 1993. Each query segment $Q_s\{q_i: q_{start,s} \leqq i \leqq q_{end,s}\}$, which is preset according to some heuristic query segmentation rule, can be regarded as a "word," and the target pitch sequence is treated as a sequence of observed features that is aligned with the given sequence of "words." To allow flexibility in aligning the target contour to the query segments, we do not impose $p_{end,s}$ to be equal to $p_{start,s+1}$. Since there are 2N boundary points to be determined, we perform the level-building on 2N levels. Level 2s−1 allows $p_{start,s}$ to deviate from $p_{end,s-1}$ over some range, while level 2s determines $p_{end,s}$ subject to the constraint $$p_{start,s-1} + \alpha_{min}(q_{end,s} - q_{start,s}) \leqq p_{end,s} \leqq p_{start,s-1} + \alpha_{max}(q_{length,s}) \tag{24}$$

where $\alpha_{min}$ and $\alpha_{max}$ are heuristically set based on the estimated range of tempo difference between the query and target. This range can be determined using the wavelet scaling factors that yielded the best match between query and target in the coarse-search stage. FIG. 4 shows an example level building scheme where the query is divided into three segments of equal length, and the target's boundary points are subject to the following constraints:

$$\begin{cases} 1 \le p_{start,s} \le 3 & s = 1 \\ p_{end,s-1} - 1 \le p_{start,s} \le p_{end,s-1} + 1 & s > 1 \\ p_{start,s-1} + 2 \le p_{end,s} \le p_{start,s-1} + 4 & s \ge 1 \end{cases} \tag{25}$$

As shown in the figure, it is possible for the resulting optimal target segments to overlap one another (e.g., $p_{start,2} < p_{end,3}$). The bias factor b in equation (22) is calculated at the second level and is propagated up the succeeding levels. The "time-normalized" integrals in equation (20) and equation (23) can be efficiently computed using the wavelet coefficients of the time-normalized signals in equation (6). The coefficients for the query segments, in particular, can be precomputed and stored for repeated use. All single path costs at odd-numbered levels are set to 0, and path costs are only accumulated at even-numbered levels to result in equation (23).

Note that if we set N=1, $q_{start,1}=1$, and $q_{end,1}=|Q|$, the problem essentially becomes the same as the prior art where we simply matched the whole query segment with varying portions of the target. On the other hand, if we set N=|Q| and $q_{start,s}=q_{end,s-1}=s$, the problem becomes essentially identical to the "optimal" DTW in equation (10). By adjusting the number of segments N, we can try to find a good compromise between computational efficiency and search accuracy.

Implementation

Figure 5:
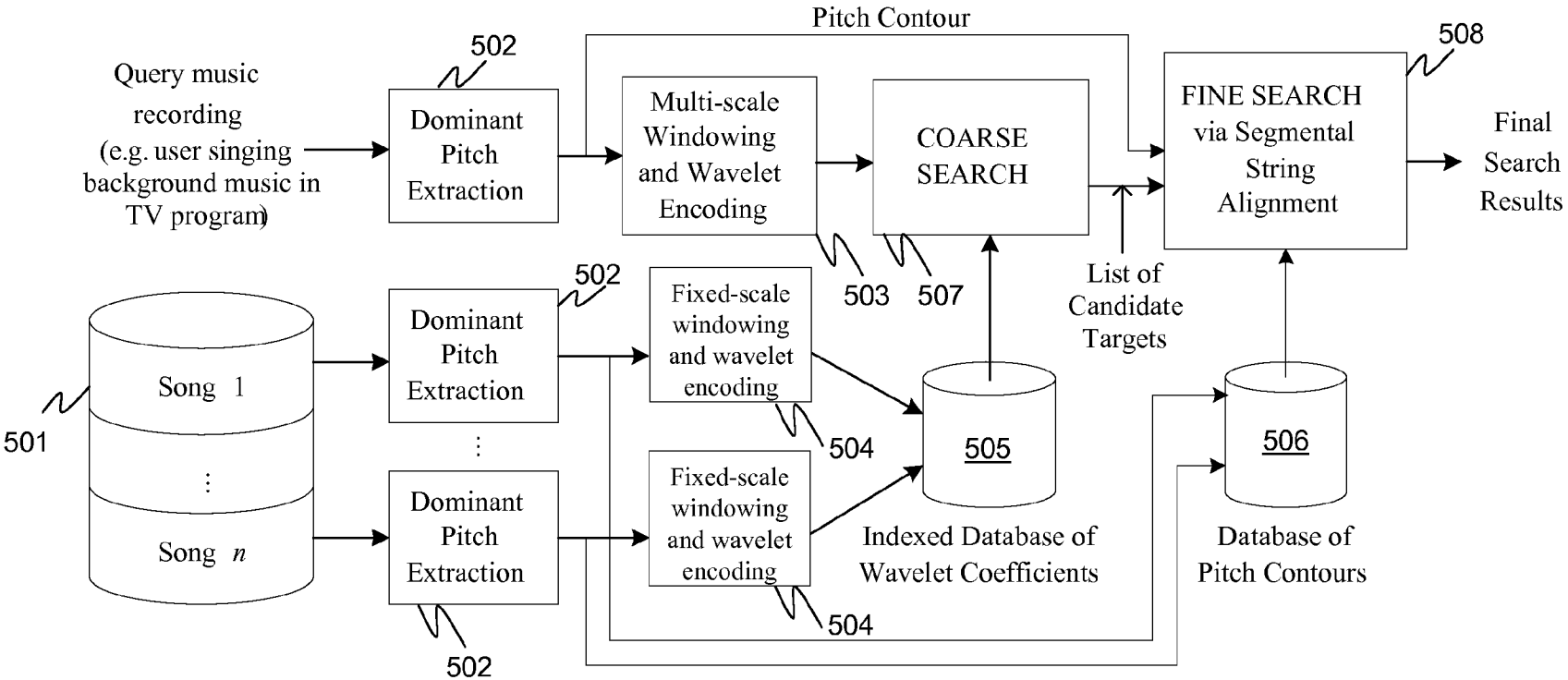
FIG. 5 is a block diagram showing apparatus for best matching an audible query to a set of audible targets.

FIG. 5 is a block diagram showing apparatus 500 for best matching an audible query to a set of audible targets. As shown, apparatus 500 comprises pitch extraction circuitry 502, multi-scale windowing and wavelet encoding circuitry 503, fixed-scale windowing and wavelet encoding circuitry 504, database of wavelet coefficients 505, database of pitch contours 506, coarse search circuitry 507, and fine search circuitry 508. Database 501 is also provided, and may lie internal or external to apparatus 500.

Databases 501, 505, and 506 comprise standard random access memory and are used to store audible targets (e.g., songs) for searching. Pitch extraction circuitry 502 comprises commonly known circuitry that extracts pitch vs. time information for any audible input signal and stores this information in database 506.

Wavelet encoding circuitry 504 receives pitch vs. time information for all targets, segments each target using fixed-length sliding windows, applies time-normalization and key-normalization on each segment, and converts each segment to a set of wavelets coefficients that represent the segment in a more compact form. These wavelet coefficients are stored in database 505.

Multi-scale windowing and wavelet encoding circuitry 503 comprises circuitry segmenting and converting the pitch-converted query to wavelet coefficient sets. Multiple portions of varying length and location are obtained from the query, and then time-normalized and key-normalized so that they can be directly compared with each target segment. For example, if the target window length is 2 seconds, and a given query is 5 seconds long, circuitry 503 may obtain multiple segments of the query by taking the ½-second portion of the query starting at 0 seconds and ending at ½ seconds, the ½-second portion of the query starting at ½ seconds and ending at 1 seconds, the 1-second portion of the query starting at 0 seconds and ending at 1 seconds, the 2½ second portion starting at 1½ seconds and ending at 4 seconds, and so on. All of these segments will be time-normalized (either expanded or shrunk) to have the same length as the lengths of the time-normalized target segments. They are also key-normalized so that they can be compared to targets independent of differences in musical key. The wavelet coefficients of each of these query segments are then obtained.

Coarse search circuitry 507 serves to provide a coarse search of the query segments over the target segments stored in database 505. As discussed above, this is accomplished by comparing each query segment with target segments to find matching candidates. The wavelet coefficients of said segments are used to do this efficiently, especially when the coefficients in database 505 are indexed into a binary tree or hash, for example. A list of potentially-matching target songs and one or more locations within each of these songs where the best match occurred are output to fine search circuitry 508.

Fine search circuitry 508 serves to take the original pitch contour of the query and then compare the original pitch contour of the query to pitch contours of candidate target songs at their locations indicated by course search circuitry. For example, if a potential matching target candidate was "Twinkle Twinkle Little Star" at a point 3 seconds into the song, fine search circuitry would then find a minimum distance between the pitch contour of the query and "Twinkle Twinkle Little Star" starting at a point around 3 seconds into the song. As discussed above, a "segmental" dynamic time warping (DTW) method is applied that calculates a more accurate similarity score between the query and each candidate target with more explicit consideration toward rhythmic inconsistencies. This results in distances along several "warping paths" being determined, and the minimum distance is chosen and associated with the target. This process is done for each target, and fine search circuitry 508 then rank orders the minimum distances for each target candidate, and presents the rank-ordered list to the user.

Figure 6:
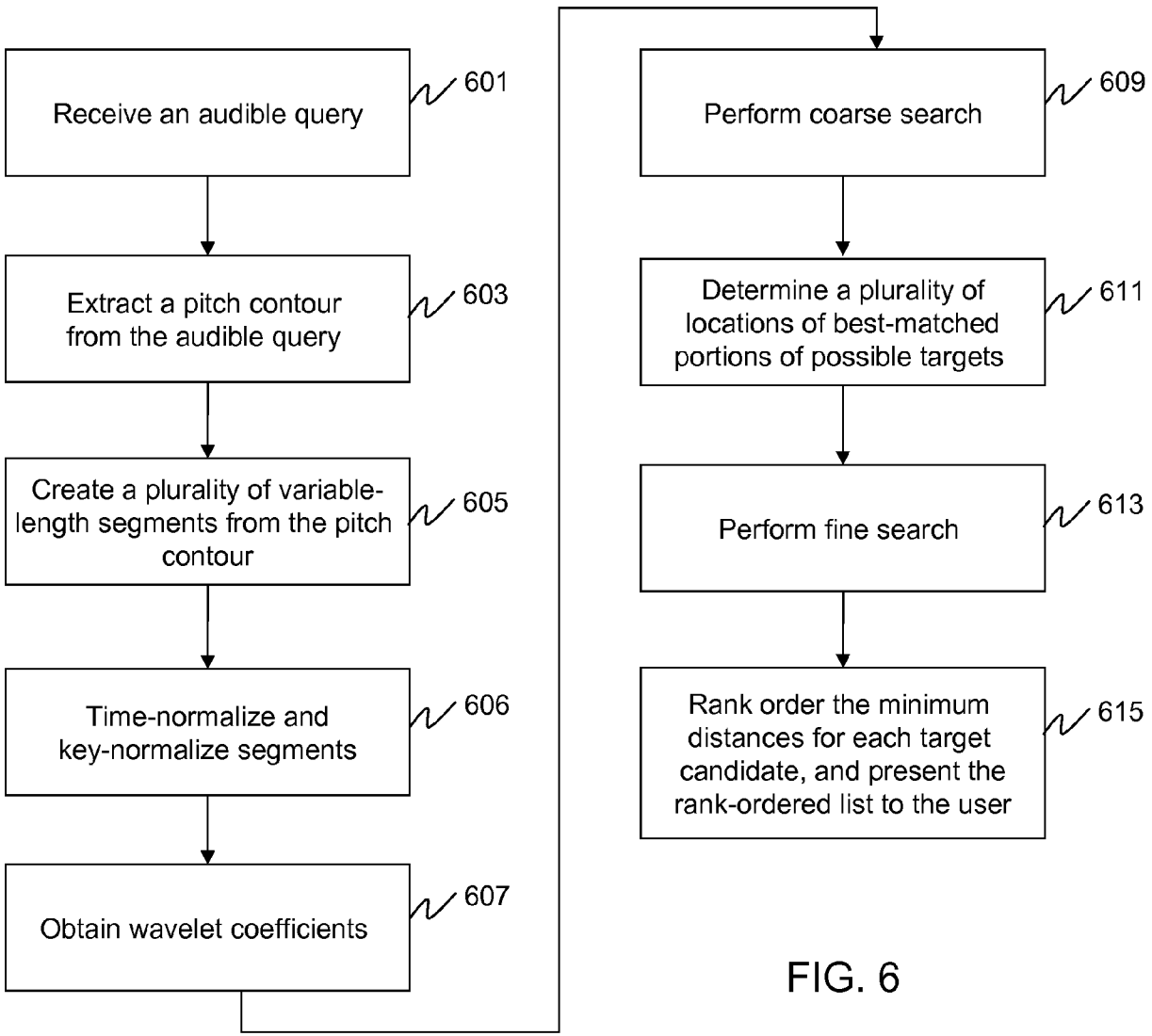
FIG. 6 is a flow chart showing operation of apparatus of FIG. 5.

FIG. 6 is a flow chart showing operation of apparatus 500. The logic flow begins at step 601 where dominant pitch extraction circuitry 502 receives an audible query (e.g., a song) of a first time period. This may, for example, comprise 5 seconds of hummed or sung music. At step 603 pitch extraction circuitry 502 extracts a pitch contour from the audible query and outputs the pitch contour to multi-scale windowing and wavelet encoding circuitry 503 and fine search circuitry 508. At step 605, multi-scale windowing and wavelet encoding circuitry 503 creates a plurality of variable-length segments from the pitch contour. At step 606, all of these segments will be time-normalized (either expanded or shrunk) by circuitry 503 to have the same length as the normalized lengths of the target segments. They are also key-normalized by circuitry 503 so that they can be compared to targets independent of differences in musical key. At step 607, the wavelet coefficients of each of these query segments are then obtained by circuitry 503 and output to coarse search circuitry 507.

At step 609, coarse search circuitry 507 compares each normalized query segment to portions of possible targets (target wavelet coefficients are stored in database 505). As discussed, this is accomplished by comparing wavelet coefficients of each query segment with wavelet coefficients of target segments to find matching candidates. At step 611, a plurality of locations of best-matched portions of possible targets is determined based on the comparison. The candidate list of targets along with a location of the match is then output to fine search circuitry 508.

At step 613, fine search circuitry 508 serves to take the original pitch contour of the query and then compare the original pitch contour of the query to pitch contours of candidate target songs at around the locations indicated by course search circuitry. Basically, a distance is determined between the pitch contour from the audible query and a pitch contour of an audible target starting at a location from the plurality of locations. This step is repeated for all locations, resulting in a plurality of distances between the query pitch contour and multiple candidate target song portions. A "segmental" dynamic time warping (DTW) method is applied to compute this distance, which is more accurate that the distance computed in the coarse search because more explicit consideration is made toward rhythmic inconsistencies. Between the query contour and each target contour location, segmental DTW chooses a minimum distance among many possible warping paths, and this distance is associated with the target based on equation (23). This process is done for all targets, and at step 615, fine search circuitry 508 then rank orders the minimum distances for each target candidate, and presents the rank-ordered list to the user (a minimum distance being the best audible target).

While the invention has been particularly shown and described with reference to a particular embodiment, it will be understood by those skilled in the art that various changes in form and details may be made therein without departing from the spirit and scope of the invention. It is intended that such changes come within the scope of the following claims:

The invention claimed is:

1. A method for matching an audible query to a set of audible targets, the method comprising the steps of:

receiving the audible query;

extracting a pitch contour from the audible query;

creating a plurality of variable-length segments from the pitch contour;

time-normalizing the plurality of variable-length segments so that each segment matches a target segment in length;

key-normalizing the plurality of time-normalized segments;

comparing each time-normalized and key-normalized segment to portions of possible targets by comparing wavelet coefficients of each time-normalized and key-normalized segment to wavelet coefficients of each time-normalized and key-normalized portion of the possible targets;

determining a plurality of locations of best-matched portions of possible targets based on the comparison.

2. The method of claim 1 further comprising the steps of:

determining a distance between the pitch contour from the audible query and a pitch contour of an audible target starting at a location taken from the plurality of locations; and repeating the step of determining the distance for the plurality of locations of best-matched portions, resulting in a plurality of distances.

3. The method of claim 2 wherein the distance comprises a minimum distance over many possible warping paths, determined by a segmental dynamic time warping algorithm.

4. The method of claim 2 further comprising the step of rank ordering the plurality of distances, designating an audible target with the least distance to the audible query as the best audible target.

5. The method of claim 1 wherein the audible targets comprises a musical piece, including vocal and instrumental music pieces.

6. The method of claim 1 wherein the audible query comprises a hummed or sung portion of a song.

7. The method of claim 1, wherein the key normalization includes subtracting mean of the time-normalized segments from pitch values of the segment.

8. A method of matching a portion of a song to a set of target songs, the method comprising the steps of:

receiving the portion of the song;

extracting a pitch contour from the portion of the song;

creating a plurality of variable-length segments from the pitch contour;

time-normalizing the plurality of variable-length segments so that each segment matches a target segment in length;

key-normalizing the time-normalized segments;

comparing each time-normalized and key-normalized segment to time-normalized and key-normalized portions of the target songs by comparing their wavelet coefficients;

determining a plurality of locations of best matched portions of the target songs based on the comparison.

9. The method of claim 8 further comprising the steps of:

determining a distance between the pitch contour from the portion of the song and a pitch contour of a target song starting at a location taken from the plurality of locations; and repeating the step of determining the distance for the plurality of locations of best matched portions, resulting in a plurality of distances.

10. The method of claim 9 wherein the distance comprises a minimum distance over many possible warping paths, determined by a segmental dynamic time warping algorithm.

11. The method of claim 9 further comprising the step of rank ordering the distances, designating the candidate target song with the least distance as the best candidate target song.

12. The method of claim 8 wherein the portion of the song comprises a hummed or sung portion of the song.

13. The method of claim 8, wherein the key normalization includes subtracting mean of the time-normalized segments from pitch values of the segment.

14. An apparatus comprising:

pitch extraction circuitry receiving an audible query and extracting a pitch contour from the query;

analysis circuitry creating a plurality of variable-length segments from the pitch contour, time-normalizing the plurality of variable-length segments so that each segment matches a target segment in length, key-normalizing the time-normalized segments, and then obtaining wavelet coefficients of the time-normalized and key-normalized segments;

coarse search circuitry comparing the wavelet coefficients of each time-normalized and key-normalized segment to wavelet coefficients of time-normalized and key-normalized portions of targets and determining a plurality of locations of best matched portions of the targets based on the comparison.

15. The apparatus of claim 14 further comprising:

fine search circuitry determining a distance between the pitch contour from the query and a pitch contour of a target starting at a location taken from the plurality of locations, and repeating the step of determining the distance for the plurality of locations for various targets, resulting in a plurality of distances.

16. The apparatus of claim 15 wherein the distance comprises a minimum distance over many possible warping paths, determined by a segmental dynamic time warping algorithm.

17. The apparatus of claim 15 wherein the fine search circuitry additionally rank orders the distances, designating the candidate target with the least distance as the best candidate target.

18. The apparatus of claim 14 wherein the portion of the query comprises a hummed or sung portion of the song.

19. The apparatus of claim 14, wherein the key normalization includes subtracting mean of the time-normalized segments from pitch values of the segment.

* * * * *

UNITED STATES PATENT AND TRADEMARK OFFICE

CERTIFICATE OF CORRECTION

PATENT NO. : 8,049,093 B2
APPLICATION NO. : 12/649458
DATED : November 1, 2011
INVENTOR(S) : Jeon et al.

It is certified that error appears in the above-identified patent and that said Letters Patent is hereby corrected as shown below:

In Column 6, Lines 26-27, in Equation (17), delete " $\begin{cases} q'_s(\theta_s) = q\{(q_{end,s} - q_{start,s})t + q_{start,s}\} \\ p'_s(\theta_s) = p\{(p_{end,s} - p_{start,s})t + p_{start,s}\} \end{cases}$ " and insert -- $\begin{cases} q'_s(t) = q\{(q_{end,s} - q_{start,s})t + q_{start,s}\} \\ p'_s(t) = p\{(p_{end,s} - p_{start,s})t + p_{start,s}\} \end{cases}$ --, therefor.

In Column 7, Line 4, in Equation (22), delete " $b = \underset{b'}{\operatorname{argmin}} \int_0^1$ " and insert -- $b = \underset{b'}{\operatorname{argmin}} \int_0^1$ --, therefor.

Signed and Sealed this
Eighth Day of January, 2013

David J. Kappos

David J. Kappos
*Director of the United States Patent and Trademark Office*